US006488218B1

(12) United States Patent
Townsend et al.

(10) Patent No.: US 6,488,218 B1
(45) Date of Patent: Dec. 3, 2002

(54) SPRINKLER HEAD CONVERSION FOR POP-UP ASSEMBLY

(75) Inventors: Michael Townsend, Waitsburg, WA (US); Robert Rupar, Walla Walla, WA (US); Craig B. Nelson, Walla Walla, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 0 days.

(21) Appl. No.: 09/953,443

(22) Filed: Sep. 17, 2001

(51) Int. Cl.[7] ..... B05B 15/10

(52) U.S. Cl. ..... 239/205; 239/200; 239/201; 239/203; 239/204; 239/288; 239/288.3; 239/288.5; 239/600

(58) Field of Search ..... 239/200, 201, 239/202, 203, 204, 205, 206, 288, 288.3, 288.5, 289, 600

(56) References Cited

U.S. PATENT DOCUMENTS

| | | | | | |
|---|---|---|---|---|---|
| 4,003,520 | A | * | 1/1977 | Bailey | 239/205 |
| 4,316,579 | A | | 2/1982 | Ray et al. | |
| 4,479,611 | A | | 10/1984 | Galvis | |
| 4,616,780 | A | | 10/1986 | Abbott | |
| 4,729,511 | A | | 3/1988 | Citron | |
| 4,781,327 | A | | 11/1988 | Lawson et al. | |
| 4,784,325 | A | | 11/1988 | Walker et al. | |
| 4,787,558 | A | | 11/1988 | Sexton et al. | |
| 4,796,809 | A | | 1/1989 | Hunter | |
| 4,886,209 | A | | 12/1989 | Dawn | |
| 4,913,352 | A | | 4/1990 | Witty et al. | |
| 5,004,157 | A | * | 4/1991 | Martell | 239/205 |
| 5,037,238 | A | | 8/1991 | Wait | |
| 5,058,806 | A | | 10/1991 | Rupar | |
| 5,141,157 | A | | 8/1992 | Han et al. | |
| 5,288,022 | A | | 2/1994 | Sesser | |
| 5,368,229 | A | | 11/1994 | Hayes et al. | |
| 5,779,148 | A | | 7/1998 | Saarem et al. | |
| 5,992,760 | A | | 11/1999 | Kearby et al. | |
| 5,996,905 | A | * | 12/1999 | Bedford | 239/204 |
| 6,186,416 | B1 | | 2/2001 | Jones | |
| 6,193,168 | B1 | * | 2/2001 | Bedford | 239/204 |
| 6,209,801 | B1 | | 4/2001 | Kearby et al. | |
| 6,357,668 | B1 | * | 3/2002 | Doshay | 239/201 |

* cited by examiner

*Primary Examiner*—Robin O. Evans
(74) *Attorney, Agent, or Firm*—Nixon & Vanderhye P.C.

(57) ABSTRACT

A pop-up sprinkler assembly includes a cylindrical housing having a cap on an upper end thereof, the cap having an opening, a lower end of the cylindrical housing having an internal thread for attachment to a source of pressurized water. A stem is mounted in the cylindrical housing with a spring radially between the stem and the cylindrical housing for normally biasing the stem to a retracted position within the cylindrical housing. The stem is extendable through the opening in the first cap to an extended position when water under pressure is supplied to the cylindrical housing. The stem has a threaded upper end to which an alternative sprinkler head is attached. An adapter housing is received over the cap and secured to the cylindrical housing, the sprinkler housing having an open upper end, the adapter housing having a diameter sufficient to receive the alternative sprinkler head when the stem is in the retracted position. A cover is secured to an upper end of the sprinkler head and adapted to close the open upper end of the adapter housing when the stem is in the retracted position. A conversion kit for adapting the otherwise incompatible sprinkler head to the pop-up assembly is also provided.

17 Claims, 3 Drawing Sheets

SPRINKLER HEAD CONVERSION FOR POP-UP ASSEMBLY

This invention relates to pop-up sprinklers and, specifically, to a conversion arrangement for adapting an existing pop-up mechanism to mount a sprinkler for which it was not specifically designed.

BACKGROUND OF THE INVENTION

Pop-up sprinklers, primarily for use in turf irrigation, are well known and typically are designed for use with a range of sprinklers available from the manufacturer of the pop-up mechanisms. Purchasers thus have limited flexibility with respect to the choice of sprinkler heads that can be used with any particular pop-up mechanism.

Examples of pop-up sprinkler devices may be found in U.S. Pat. Nos. 4,316,579; 4,476,611; 4,781,327; 4,913,352; and 5,779,148.

It would be advantageous for consumers to be able to "mix and match" sprinkler components and thus increase the range of options available to meet specific needs.

BRIEF SUMMARY OF THE INVENTION

This invention provides a conversion arrangement that enables the sprinkler heads of one manufacturer to be utilized with the pop-up mechanism of another manufacturer. Specifically, in one embodiment, an enlarged adapter or sprinkler housing and coupler are designed for attachment to the stationary housing component of a well known pop-up mechanism. The adapter housing is sized and shaped to receive an alternative or enhanced performance sprinkler head when the pop-up mechanism is retracted. Additional sleeve and cap adapters are provided that enable the sprinkler head to be threadably attached to the extendable/retractable stem component of the pop-up mechanism, and for a suitably sized cap to be secured to the sprinkler head so as to close the adapter housing when the pop-up device is retracted. No alterations to the pop-up mechanism are required, and no tools are needed to implement the conversion. The invention thus provides the user with additional flexibility in selecting a sprinkler head with desired performance specifications for use with an otherwise incompatible pop-up mechanism.

Accordingly, the present invention relates to a pop-up sprinkler assembly comprising: a cylindrical housing having a cap on an upper end thereof, the cap having an opening, a lower end of the cylindrical housing having an internal thread for attachment to a source of pressurized water; a stem mounted in the cylindrical housing with a spring radially between the stem and the cylindrical housing for normally biasing the stem to a retracted position within the cylindrical housing, the stem extendable through the opening in the first cap to an extended position when water under pressure is supplied to the cylindrical housing, the stem having a threaded upper end; a sprinkler head attached to the threaded upper end of the stem; a sprinkler housing received over the cap and secured to the cylindrical housing, the sprinkler housing having an open upper end, the adapter housing having a diameter sufficient to receive the sprinkler head when the stem is in the retracted position; and a cover secured to an upper end of the sprinkler head and adapted to close the open upper end of the adapter housing when the stem is in the retracted position.

In another aspect, the invention relates to a conversion kit for adapting a sprinkler pop-up assembly to receive an alternative sprinkler head, wherein the pop-up assembly includes a cylindrical housing and an extendable stem, the cylindrical housing having a cap at its upper end, the cap having a through-opening for the stem; the stem having a threaded tip; the kit comprising a sleeve adapter for connection between a lower end of the alternative sprinkler head and the threaded tip of the stem; an adapter housing for enclosing the alternative sprinkler head when the stem is retracted, the adapter housing having an open upper end and a diameter larger than the cylindrical housing, and a threaded lower end having a diameter larger than the cap; a coupler having an internal thread for threaded engagement with the threaded lower end of the adapter housing, the coupler slidably received on the cylindrical housing upstream of the cap to thereby secure the adapter housing to the cylindrical housing; a cover for the alternative sprinkler head; and a cover adapter for connection between the alternative sprinkler head and said cover; wherein the cover is sized to close the open upper end of the adapter housing when the stem is in the retracted position.

Other objects and advantages of the subject invention will become apparent from the detailed description that follows.

DETAILED DESCRIPTION OF THE INVENTION

Figure 1:
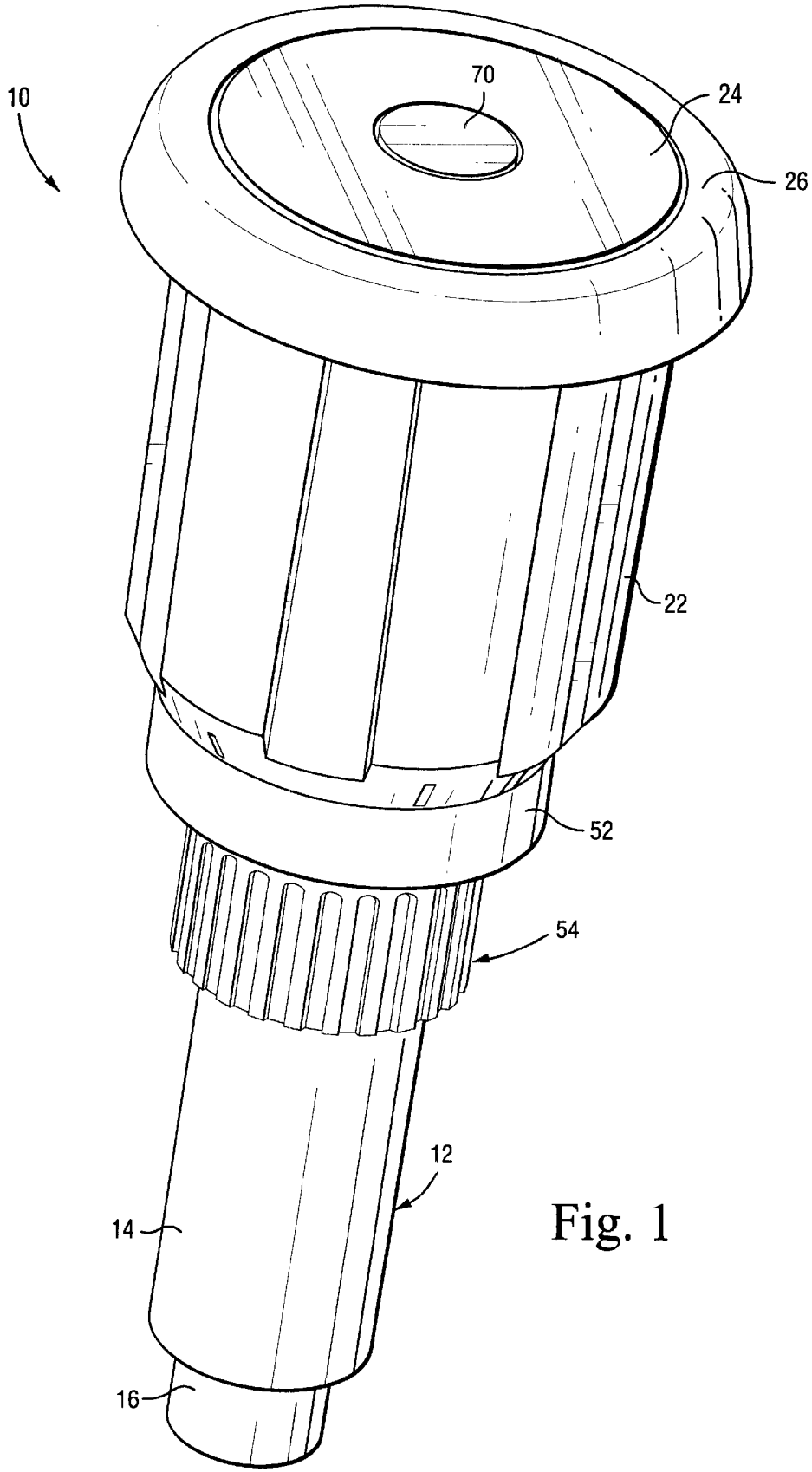
FIG. 1 is a perspective view of a converted pop-up sprinkler assembly in accordance with an exemplary embodiment of the invention.
Figure 2:
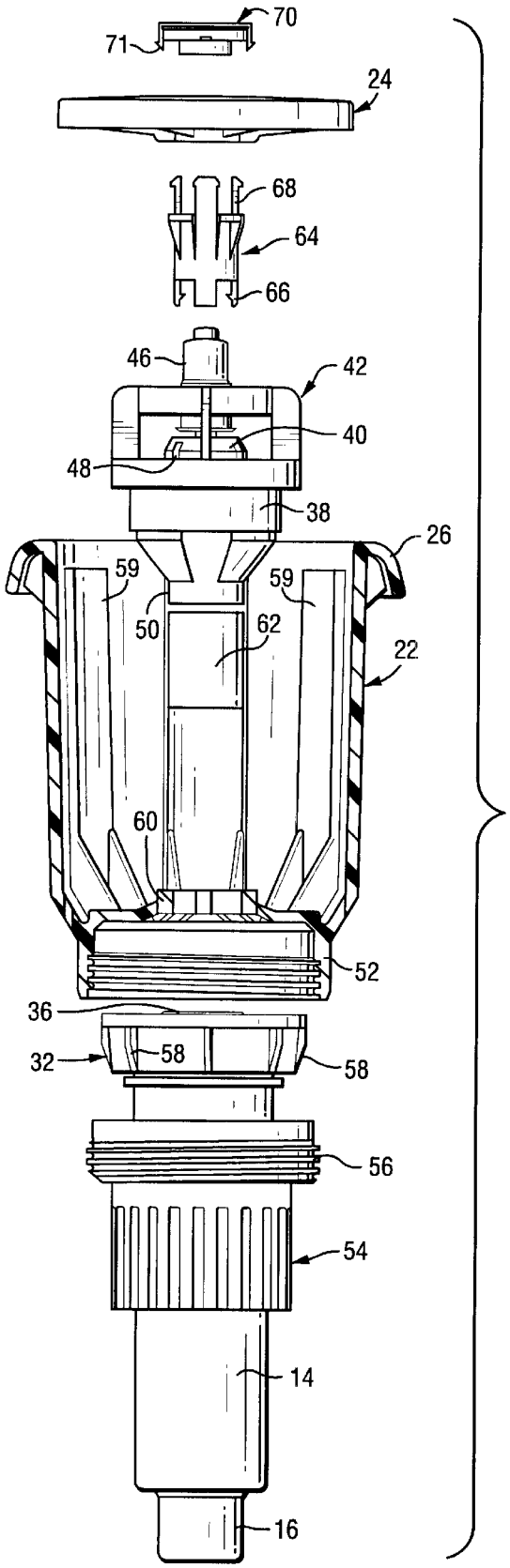
FIG. 2 is an exploded side elevation, partly in section, of the pop-up sprinkler assembly shown in FIG. 1.
Figure 3:
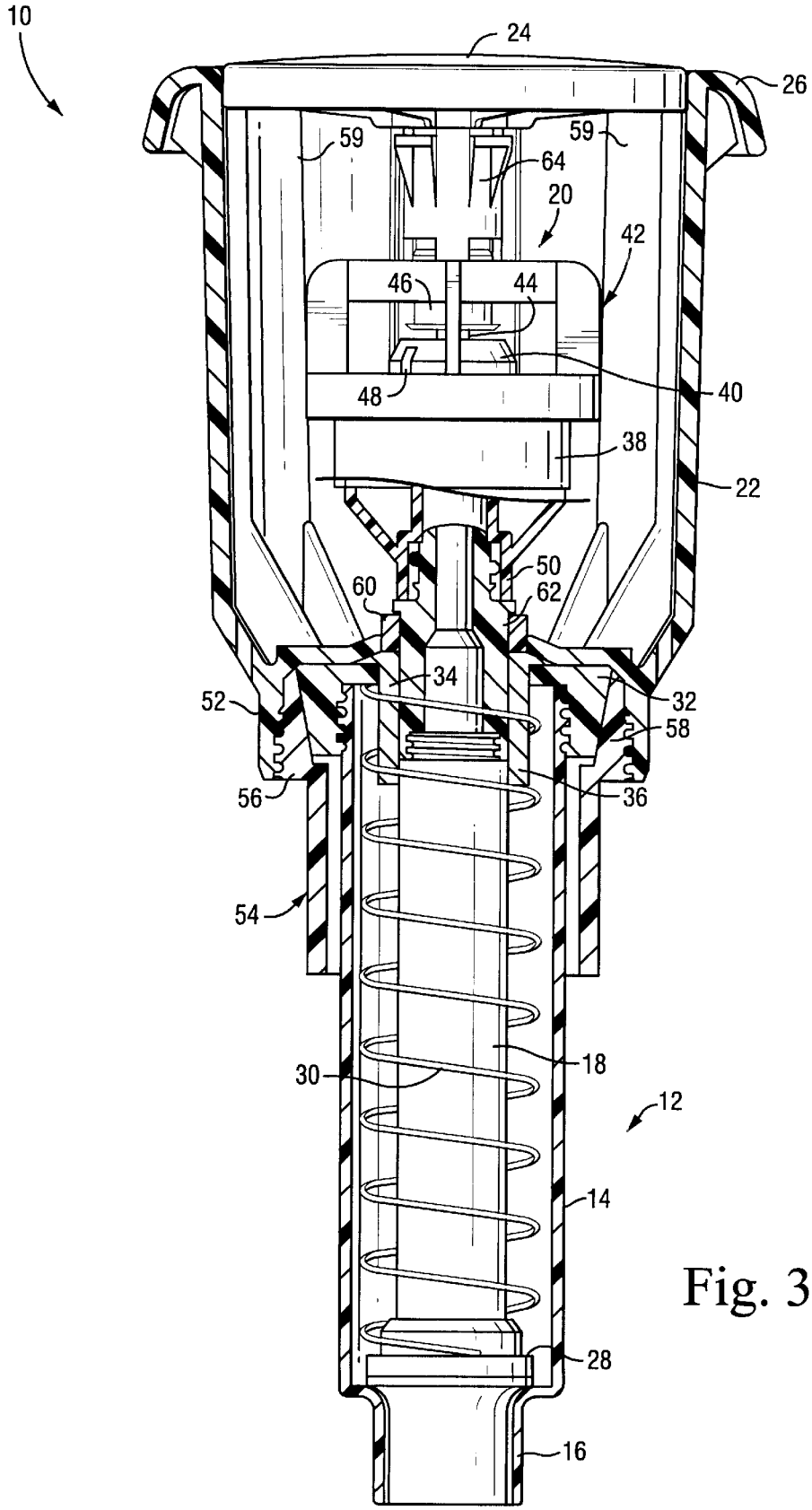
FIG. 3 is a side elevation, partly in section, of the assembly shown in FIG. 1.

With reference to FIG. 1, a rotating sprinkler pop-up assembly 10 includes a conventional pop-up mechanism 12 comprising a cylindrical housing 14 having a threaded inlet end 16 for connection to a sprinkler system riser or water supply pipe. The pop-up assembly 10 also includes an internal extendable/retractable stem 18 (see FIGS. 2 and 3) that supports a sprinkler head 20 (FIGS. 2 and 3). In FIG. 1, the sprinkler head 20 is enclosed within an enlarged adapter or sprinkler housing 22, with the stem 18 in its retracted position. In the retracted position, a sprinkler cover 24 is substantially flush with an upper peripheral rim 26 of the housing 22.

More specifically, and with particular reference to FIGS. 2 and 3, the stem 18 of the conventional pop-up assembly 12 is provided with a lower flange 28 that supports a coil spring 30 extending axially between the flange 28 and the underside of a cap 32 threadably secured to the upper end of the cylindrical housing 14. The cap 32 has a central opening 34 with a rubber seal or bearing 36 pressed or bonded therein, and through which the pop-up stem 18 slides when moving between its extended and retracted positions. This arrangement results in the stem 18 and sprinkler head 20 being biased to a normally retracted position shown in FIG. 1. Upon supply of water under pressure, the stem 18 and sprinkler head 20 are caused to move upwardly, against the bias of spring 30, to an extended sprinkling position. Pop-up assemblies of this type are well known, and one example is the 1800™ Series available from Rainbird Sprinkler Corp.

This invention relates to the manner in which the rotating sprinkler head 20, not specifically made for attachment to a Rainbird 1800™ Series—or similar pop-up assembly, can be adapted for use therewith. The sprinkler head 20 may therefore be regarded as an "alternative" sprinkler head.

The rotating sprinkler head 20 includes a sprinkler body 38 incorporating a nozzle (not shown) that emits a stream for impingement on a rotor or water distribution plate 40 supported on a sprinkler head cap assembly 42. In the illustrated embodiment, the rotor plate 40 is secured to a shaft 44 for rotation about a vertical axis extending through the sprinkler body 38 (and nozzle orifice). The opposite end of the shaft 44 may be supported in a viscous damping device or "motor" 46, supported in the sprinkler head cap assembly 42. The viscous damping device or motor 46 retards the rotational speed of the rotor plate that is provided with one or more grooves 48 configured to cause the rotor plate 40 to rotate when impinged upon by the stream emitted from the nozzle. The sprinkler head 20 is also conventional and may be of the type available from Nelson Irrigation Corporation under the name R2000 Rotator.™

The sprinkler body 38 is provided with an interiorly threaded lower end 50 that would normally be secured to a riser or pop-up stem, such as stem 18.

In accordance with this invention, the enlarged adapter or sprinkler housing 22 is formed with an interiorly threaded upstream end 52 that has a diameter sufficiently large to slip over the cap 32 in the pop-up housing 14. A coupler nut 54 having an upper external thread 56, is slidable over the cylindrical pop-up housing 14 from below, and threadably engageable with the upstream end 52 of the adapter or sprinkler housing 22, locating on tapered reinforcment ribs 58 on the cap 32 and effectively locking the enlarged adapter housing 22 to the pop-up housing 14 via cap 32. Internally, the upstream or bottom end of the adapter housing 22 is provided with a central opening with a bearing 60 that provides added support for the pop-up stem 18, especially when the latter is in the extended position. Internally, the housing 22 is formed with circumferentially spaced, elongated ribs 59 that not only reinforce the housing but also provide a stop for the cover 24 when the stem and sprinkler head are in the retracted position, thus providing the flush fit apparent in FIG. 1.

A sleeve adapter 62 formed with a male thread on its upper end and a female thread on its lower end, is threadably secured at one end to the lower end 50 of the sprinkler head 20, and at the opposite end to the exteriorly threaded upper end of the pop-up stem 18.

At the upper or downstream end of the sprinkler head 20, a sprinkler cover adapter 64, best seen in FIG. 2, includes circumferentially spaced lower, flexible prongs 66 that are adapted to snap into a pair of already existing round apertures in the sprinkler cap assembly 42, about the motor 46. At the same time, a plurality (four in the exemplary embodiment) of circumferentially spaced upper flexible prongs 68 are adapted to snap into corresponding apertures in the pop-up sprinkler cover 24 and covered by a retainer 70 (that also snaps into place via prongs 71) to thereby fix the sprinkler cover 24 onto the sprinkler cap assembly 42, but in axially spaced relation thereto. This arrangement accommodates the motor 44 and provides the necessary stop interaction relative to the enlarged adapter housing 22. In other words, on shut-off of the water, the sprinkler head 20 and stem 18 will retract into the adapter housing 22 and cylindrical housing 14 until the sprinkler cover 24 engages interior axially extending ribs 72 arranged about the interior of the adapter housing 22 such that, when so engaged, the top of the cover 24 is substantially flush with the peripheral rim 26 of the enlarged adapter housing 22.

The above described enlarged adapter or sprinkler housing 22, sprinkler cover 24, coupler nut 54, sleeve adapter 62, pop-up cap adapter 64 and retainer 70 may be made available in kit form, with or without the sprinkler head 20, to enable wider use of the conventional pop-up mechanism. In other words, sprinkler 20, or others with similar attachment points, may be available separately from the conversion kit.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A pop-up sprinkler assembly comprising:

a cylindrical housing having a cap on an upper end thereof, said cap having an opening, a lower end of said cylindrical housing having an internal thread for attachment to a source of pressurized water;

a stem mounted in said cylindrical housing with a spring radially between said stem and said cylindrical housing for normally biasing said stem to a retracted position within said cylindrical housing, said stem extendable through said opening in said cap to an extended position when water under pressure is supplied to said cylindrical housing, said stem having a threaded upper end;

a sprinkler head attached to said threaded upper end of said stem;

an adapter housing received over said cap and secured to said cylindrical housing, said sprinkler housing having an open upper end, said adapter housing having a diameter sufficient to receive said sprinkler head when said stem is in said retracted position; and a cover secured to an upper end of said sprinkler head and adapted to close said open upper end of said adapter housing when said stem is in said retracted position.

2. The assembly of claim 1 including a sleeve adapter connected axially between said threaded upper end of said stem and a lower end of said sprinkler head.

3. The assembly of claim 1 wherein said sprinkler head includes a nozzle and a cap assembly supported above said nozzle, said cap assembly supporting a rotatable water distribution plate above said nozzle.

4. The assembly of claim 3 and further comprising a cover adapter extending between said cap assembly and said cover, such that said cover is axially spaced above said cap assembly.

5. The assembly of claim 3 wherein said adapter housing is provided with a plurality of circumferentially spaced ribs and wherein said cover engages said ribs when said stem and said sprinkler head are in the retracted position.

6. The assembly of claim 4 wherein said cover adapter is formed with a plurality of flexible prongs at opposite ends thereof that are engaged within respective apertures in said cap assembly and said cover.

7. The assembly of claim 3 wherein said water distribution plate is mounted on one end of a shaft, an opposite end of the shaft received in a viscous retarder device mounted in said cap assembly.

8. The assembly of claim 1 wherein said adapter housing is formed with an integral bottom having a central opening therein including a bearing for supporting said stem.

9. The assembly of claim 2 wherein said sleeve adapter is formed with a male thread on one end and a female thread on an opposite end.

10. A conversion kit for adapting a sprinkler pop-up assembly to receive an alternative sprinkler head, wherein the pop-up assembly includes a cylindrical housing and an extendable stem, the cylindrical housing having a cap at its upper end, the cap having a through-opening for the stem; the stem having an externally threaded tip; the kit comprising:

a sleeve adapter for connection between a lower end of the alternative sprinkler head and the externally threaded tip of the stem;

an adapter housing for enclosing the alternative sprinkler head when the stem is retracted, the adapter housing having an open upper end and a diameter larger than said cylindrical housing, and a threaded lower end having a diameter larger than said cap;

a coupler having an internal thread for threaded engagement with said threaded lower end of said adapter housing, said coupler slidably received on said cylindrical housing upstream of said cap to thereby secure said adapter housing to said cylindrical housing;

a cover for the alternative sprinkler head; and a cover adapter for the alternative sprinkler head; wherein said cover is sized to close the open upper end of said adapter housing when the stem is in the retracted position.

11. The conversion kit of claim 10 in combination with the alternative sprinkler head.

12. The conversion kit of claim 11 wherein said alternative sprinkler head includes a nozzle and a cap assembly supported above said nozzle, said cap assembly supporting a rotatable water distribution plate above said nozzle.

13. The conversion kit of claim 10 wherein said adapter housing is provided with a plurality of circumferentially spaced ribs and wherein said cover engages said ribs when said stem and said alternative sprinkler head are in the retracted position.

14. The conversion kit of claim 10 wherein said cover adapter is formed with a plurality of flexible prongs at opposite ends thereof to facilitate connection of said alternative sprinkler head to said cover.

15. The conversion kit of claim 12 wherein said water distribution plate is mounted on one end of a shaft, an opposite end of the shaft received in a viscous retarder device mounted in said cap assembly.

16. The conversion kit of claim 10 wherein said adapter housing is formed with an integral bottom having a central opening therein including a bearing for supporting said stem.

17. The conversion kit of claim 10 wherein said sleeve adapter is formed with a male thread on one end and a female thread on an opposite end.

* * * * *

UNITED STATES PATENT AND TRADEMARK OFFICE

CERTIFICATE OF CORRECTION

PATENT NO. : 6,488,218 B1
DATED : December 23, 2002
INVENTOR(S) : Townsend et al.

It is certified that error appears in the above-identified patent and that said Letters Patent is hereby corrected as shown below:

Column 2,
Lines 40 and 41, delete "FIGS. 2 and 3" and insert -- FIG. 3 --.
Lines 47 and 48, delete "FIGS. 2 and 3" and insert -- FIG. 3 --.

Column 3,
Lines 34 and 35, after "elongated" and insert -- axially-extending --.
Line 57, after "44" insert -- (see FIG. 3) --.
Line 62, delete "axially extending ribs 72" and insert -- circumferentially-spaced axially-extending ribs 59 --.

Signed and Sealed this

Thirtieth Day of December, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,488,218 B1
DATED : December 3, 2002
INVENTOR(S) : Townsend et al.

It is certified that error appears in the above-identified patent and that said Letters Patent is hereby corrected as shown below:

Column 2,
Lines 40 and 41, delete "FIGS. 2 and 3" and insert -- FIG. 3 --.
Lines 47 and 48, delete "FIGS. 2 and 3" and insert -- FIG. 3 --.

Column 3,
Lines 34 and 35, after "elongated" and insert -- axially-extending --.
Line 57, after "44" insert -- (see FIG. 3) --.
Line 62, delete "axially extending ribs 72" and insert -- circumferentially-spaced axially-extending ribs 59 --.

This certificate supersedes Certificate of Correction issued December 30, 2003.

Signed and Sealed this

Sixth Day of April, 2004

JON W. DUDAS
*Acting Director of the United States Patent and Trademark Office*